US006589403B2

(12) United States Patent
Ikeda et al.

(10) Patent No.: US 6,589,403 B2
(45) Date of Patent: Jul. 8, 2003

(54) ELECTROLYSIS GAS CONVERTER AND ELECTRIC DEVICE USING SAME

(75) Inventors: Akira Ikeda, Tokyo (JP); Akihiko Iwata, Tokyo (JP); Shigeo Ueguri, Tokyo (JP); Yoshikazu Tsunoda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/790,686

(22) Filed: Feb. 23, 2001

(65) Prior Publication Data

US 2001/0017259 A1 Aug. 30, 2001

(30) Foreign Application Priority Data

Feb. 25, 2000 (JP) ..... 2000-048496
Sep. 26, 2000 (JP) ..... 2000-291740

(51) Int. Cl.[7] ..... C25B 9/04; C25B 15/00; C25B 9/00

(52) U.S. Cl. ..... 204/230.8; 204/241; 204/265; 204/266

(58) Field of Search ..... 204/252, 265, 204/266, 241, 239, 236, 230.2, 230.8, 230.6

(56) References Cited

U.S. PATENT DOCUMENTS 4,416,747 A 11/1983 Menth et al. ..... 204/129
4,424,105 A * 1/1984 Hanson ..... 204/229.1

FOREIGN PATENT DOCUMENTS

| | | | |
|---|---|---|---|
| JP | 53-021088 | | 2/1978 |
| JP | 6-63343 | | 3/1994 |
| JP | 7-157301 | | 6/1995 |
| JP | 09-071889 | * | 3/1997 |
| JP | 11-131276 | | 5/1999 |
| JP | 11-171504 | | 6/1999 |

* cited by examiner

*Primary Examiner*—Patrick Ryan
*Assistant Examiner*—Thomas H. Parsons
(74) *Attorney, Agent, or Firm*—Oblon, Spivak, McClelland, Maier & Neustadt, P.C.

(57) ABSTRACT

There is provided an electrolysis gas converter, which prevents excessive gas generation and can maintain a constant amount of gas conversion even if outside air conditions such as humidity changes. The converter, which provides DC current to a jointed electrochemical device 8 comprising a solid polymer electrolytic film 3 between an anode 1 and a cathode 2 having a catalytic layer on a base substrate of conductive porous material, comprises means 11 and 17 which provide a fixed current to the jointed electrochemical device 8.

18 Claims, 13 Drawing Sheets

ELECTROLYSIS GAS CONVERTER AND ELECTRIC DEVICE USING SAME

BACKGROUND OF THE INVENTION

1. Field of the Invention

The present invention relates to an electrolysis gas converter according to electrochemical reaction using a solid polymer electrolytic film. Specifically, it relates to an electrolysis gas converter such as a generator of ozone gas, oxygen gas or hydrogen gas, dehumidifying device or the like, which converts water in air into ozone gas, oxygen gas, hydrogen gas or the like according to an electrochemical reaction, wherein a solid polymer electrolytic film is interposed between an anode and a cathode and wherein DC voltage is induced thereto. The converter is applied for a generator of ozone gas, oxygen gas or hydrogen gas, dehumidifying device or the like.

2. Description of Related Art

FIG. 12 is a construction view of an ozone generator which is one of the examples of conventional electrolysis gas converters disclosed, for example, in Japanese Unexamined Patent Publication No. 131276/1999. In FIG. 12, numeral 1 indicates an anode having a catalytic layer on anode base substrate comprising conductive porous material, numeral 2 indicates a cathode having a catalytic layer on cathode base substrate comprising conductive porous material, and numeral 3 indicates a solid polymer electrolytic film. A jointed electrochemical device 8 is formed by hot press with placing the anode 1 and the cathode 2 on both surfaces of the solid polymer electrolytic film 3. Numeral 4 is an anode terminal placed on the anode 1, numeral 5 is a cathode terminal on the cathode 2, numeral 6 is a DC power source, numeral 7 is a connection cable coupling the DC power source 6 with the anode 1 and the cathode 2.

For the anode 1, there is used, for example, a material formed by thinly electrodepositing β or α lead dioxide onto an expand metal substrate made of titanium having platinum-plated base. For the cathode 2, there is used a material formed by sticking a carbon powder carrying platinum particles onto a porous carbon fiber substrate using a liquefied solid polymer electrolyte as a binder.

Next, explanation is made as to operation. For example, when 3 V of DC voltage through a DC power 6 is induced to the jointed electrochemical device 8, water in air is electrolyzed at the jointed surface of the anode 1 and a solid polymer electrolytic film 3. Therefore, hydrogen ion is generated, ozone gas, oxygen gas and electrons are generated according to the electrochemical reaction formulas (1) and (2).

$$2H_2O \rightarrow O_2 + 4H^+ + 4e^- \quad (1)$$

$$3H_2O \rightarrow O_3 + 6H^+ + 6e^- \quad (2)$$

The thus generated ozone gas and oxygen gas are released outside through the porous anode 1.

On the other hand, the generated hydrogen ions move to the cathode 2 through the solid polymer electrolytic film 3. According to electrochemical reaction formula (3), the moved hydrogen ions react with the electrons led to the cathode 2 through oxygen gas in air and the connection cable 7 to generate water at the jointed surface of the cathode 2 and the solid polymer electrolytic film 3. And it is released outside through the porous cathode 2.

$$O_2 + 4H^+ + 4e^- \rightarrow 2H_2O \quad (3)$$

When a jointed electrochemical device 8 is used for a device generating oxygen or dehumidifying, namely when the electrolysis gas converter corresponds to a oxygen gas generator or a dehumidifying device, there is used, for example, a material obtained by plating platinum onto a porous expand metal substrate made of titanium as the anode 1 of the electrochemical device 8, and it generates oxygen at the anode and water at the backside of the cathode. Also, when an electrochemical device 8 is used for generating hydrogen, namely when the electrolysis gas converter corresponds to a hydrogen gas generator, there is used, for example, a material obtained by plating of platinum onto a porous expand metal substrate made of titanium as the anode 1 and the cathode 2, and it generates hydrogen at the cathode.

As mentioned above, in case a conventional electrolysis gas converter is, for example, an ozone generator, it generates ozone gas by electrolysis of water in air with the jointed electrochemical device 8. For this reason, there was a problem that the ozone generation amount varies depending on outside humidity to provide an unstable ozone generation amount, and that too much ozone is generated when the humidity is increased.

FIG. 13 shows the result of experiments using the ozone generator shown in FIG. 12. It is a view illustrating influence of relative humidity against relationship between ozone generation amount and induced voltage, and between current density and the induced voltage. Each value of the ozone generation amount and the current density is based on per 1 $cm^2$ of the electrochemical reaction part of the jointed electrochemical device 8 at 20° C.

As shown in FIG. 13, the ozone generation amount and the current density are increased when outside humidity is increased, while the ozone generation amount is increased in accordance with increase of current which flows through the jointed electrochemical device 8. On the other hand, load resistance of the jointed electrochemical device 8 during electricity flow varies complicatedly in accordance with the outside humidity. However, under a constant humidity condition, when the voltage induced to the jointed electrochemical device 8 is at most 3 V, current flow is decreased to decrease in ozone generation amount.

In order to control the jointed chemical device 8 having such properties to the state that it does not extremely generate or decrease ozone gas, only inducing of a constant voltage is not sufficient. For example, when the voltage is set to 3 V, the ozone generation amount is 0.08 mg/hr/$cm^2$ at relative humidity of 35% (shown as C in the figure), and 0.50 mg/hr/$cm^2$ at relative humidity of 95% (shown as C in the figure), which means that it varies by as much as about 6 times. Also, when the voltage is set to 1.8 V, the ozone generation amount almost equals to zero at 35% of the relative humidity and 0.09 (mg/hr/$cm^2$) at 95% of the relative humidity. In short, it is not appropriate to operate the jointed electrochemical device 8 under a fixed voltage condition.

Furthermore, other conventional electrolysis gas converters such as a dehumidifying device, an oxygen gas generator and a hydrogen gas generator have a problem that the gas conversion amount varies in accordance with outside humidity and gas conversion amount is unstable since they are designed similarly to the ozone generator to convert water in air into gas according to electrolysis with the jointed electrochemical device 8.

SUMMARY OF THE INVENTION

The present invention has been carried out in order to solve the above problems. The object of the present invention is to prepare an electrolysis gas converter which can maintain a stable gas conversion amount without excessive gas generation by using a simple controlling means even if outside air conditions change. Also, another object of the present invention is to obtain an electric device equipped with the electrolysis gas converter, which can maintain a stable gas conversion amount.

As a result of intensive study on relationship between gas conversion amount of the conventional electrolysis gas converter and current flowing through the jointed electrochemical device, and between the gas conversion amount and induced voltage, the present invention has been completed based on the findings that the gas conversion can be maintained to a fixed amount by supplying a fixed current through the electrochemical device.

The first gas converter of the present invention comprises a jointed electrochemical device, which is obtained by inserting a solid polymer electrolytic film between an anode and a cathode having a catalytic layer on a base substrate of conductive porous material, and which decomposes water in air by inducing DC current thereto, wherein the converter is equipped with a means for supplying a fixed current to the jointed electrochemical device.

The second electrolysis gas converter of the present invention is that in the first gas converter, the DC current is supplied through a rectification circuit from an alternating input and the means for supplying the fixed current flow is a condenser connected in series between the above alternating input and the above rectification circuit.

The third electrolysis gas converter of the present invention is that in the second gas converter, a device for controlling voltage induced to the jointed electrochemical device is connected in parallel to the above jointed electrochemical device.

The fourth electrolysis gas converter of the present invention is that in the first gas converter, the means for controlling the fixed current flow is a resistor connected in series between the jointed electrochemical device and a DC power source.

The fifth electrolysis gas converter of the present invention is that in the first gas converter, the jointed electrochemical device is used as an ozone generator.

The sixth electrolysis gas converter of the present invention is that in the second gas converter, the jointed electrochemical device is used as an ozone generator.

The seventh electrolysis gas converter of the present invention is that in the fourth gas converter, the jointed electrochemical device is used as an ozone generator.

The eighth electrolysis gas converter of the present invention is that in the first gas converter, the jointed electrochemical device is used as an oxygen gas generator.

The ninth electrolysis gas converter of the present invention is that in the second gas converter, the jointed electrochemical device is used as an oxygen gas generator.

The tenth electrolysis gas converter of the present invention is that in the fourth gas converter, the jointed electrochemical device is used as an oxygen gas generator.

The eleventh electrolysis gas converter of the present invention is that in the first gas converter, the jointed electrochemical device is used as a hydrogen gas generator.

The twelfth electrolysis gas converter of the present invention is that in the second gas converter, the jointed electrochemical device is used as a hydrogen gas generator.

The thirteenth electrolysis gas converter of the present invention is that in the fourth gas converter, the jointed electrochemical device is used as a hydrogen gas generator.

The fourteenth electrolysis gas converter of the present invention is that in the first gas converter, the jointed electrochemical device is used as a dehumidifying device.

The fifteenth electrolysis gas converter of the present invention is that in the second gas converter, the jointed electrochemical device is used as a dehumidifying device.

The sixteenth electrolysis gas converter of the present invention is that in the fourth gas converter, the jointed electrochemical device is used as a dehumidifying device.

The first electric appliance of the present invention comprises the first gas converter.

The second electric appliance of the present invention comprises the second gas converter.

The third electric appliance of the present invention comprises the fourth gas converter.

DETAILED DESCRIPTION

Embodiment 1

The electrolysis gas converter according to Embodiment 1 of the present invention is explained below with an ozone generator as an example.

Figure 1:
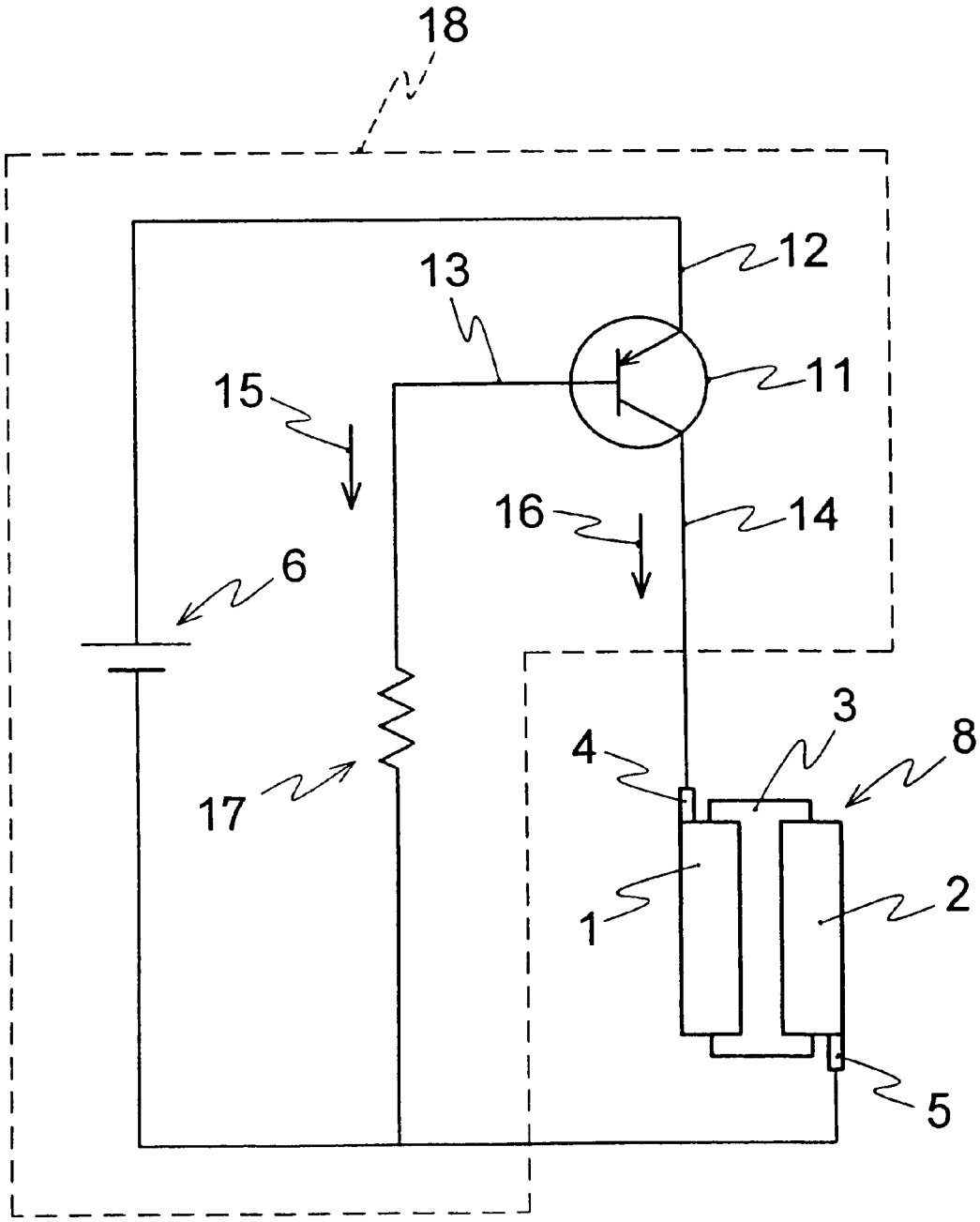
FIG. 1 is a view illustrating a construction of the electrolysis gas converter according to Embodiment 1 of the present invention.

FIG. 1 is a view illustrating a construction of the electrolysis gas converter according to Embodiment 1 of the present invention. In FIG. 1, numeral 1 indicates an anode having a catalytic layer on a base substrate comprising conductive porous material, numeral 2 a cathode having a catalytic layer on a base substrate comprising conductive porous material, numeral 3 a solid polymer electrolytic film, numeral 4 an anode terminal equipped on the anode 1, numeral 5 a cathode terminal equipped on the cathode 2, numeral 6 a DC power source, numeral 8 a jointed electrochemical device formed by hot-pressing the anode 1 and the cathode 2 on each surface of the solid polymer electrolytic film 3, numeral 11 a PNP transistor, for example, numeral 12 an emitter of the PNP transistor 11, numeral 13 a base thereof, numeral 14 a collector thereof, numeral 15 current flowing between the emitter 12 and the base 13, numeral 16 current flowing through the jointed electrochemical device (collector current flowing through the collector 14), numeral 17 a resistor, and numeral 18 a DC constant current power source comprising the DC power source 6, the PNP transistor 11 and the resistor 17. The jointed electrochemical device 8 is connected between low electric potential output of the DC power source 6 and the collector 14 of the PNP transistor, and the emitter 12 is connected to the other output of the DC power source 6. Also, the resistor 17 is connected between the low electric potential output of the DC power source 6 and the base 13 of the PNP transistor.

In this embodiment, the PNP transistor 11 and the resistor 17 form a means for controlling the current 16 which flows through the jointed electrochemical device 8 to be a fixed current.

For example, as the anode 1, there is used a material formed by thinly electrodepositing β or α lead dioxide onto an expand metal substrate made of titanium having platinum-plated base. As the cathode 2, there is used a material formed by sticking a carbon powder carrying platinum particles onto a porous carbon fiber substrate by using a liquefied solid polymer electrolyte as a binder.

Figure 2:
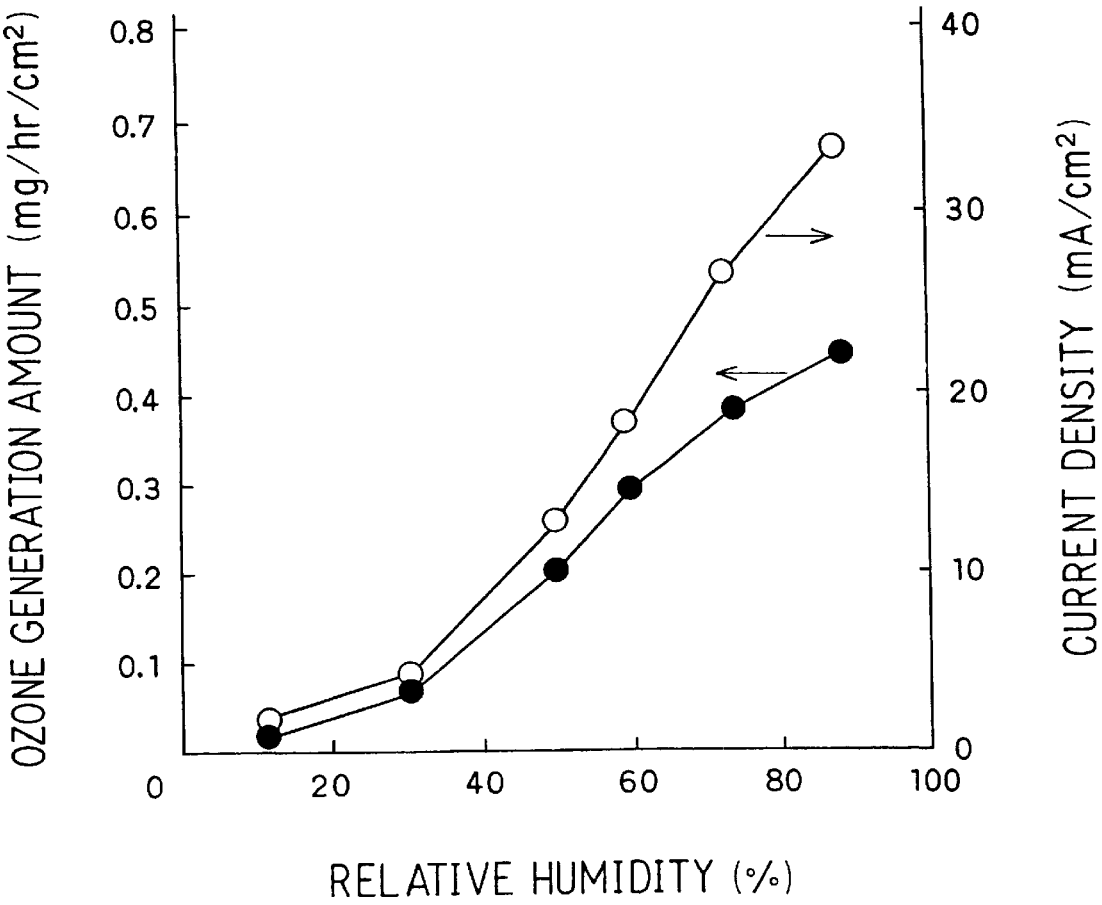
FIG. 2 is a view illustrating relationship between ozone generation amount from the jointed electrochemical device and outside relative humidity, and between current density and the outside relative humidity when a constant voltage is induced to the jointed electrochemical device using a DC power source in Embodiment 1 of the present invention.

Next, test results are shown. FIG. 2 is a view illustrating relationship of ozone generation amount and current density against outside relative humidity based on 1 $cm^2$ of the electrochemical reaction part of the jointed electrochemical device 8, in case of inducing 3 V of voltage to the jointed electrochemical device 8 (having 4 $cm^2$ of the electrochemical reaction part interposed between the anode 1 and cathode 2) by the D.C. power source 6 at 20° C.

Figure 3:
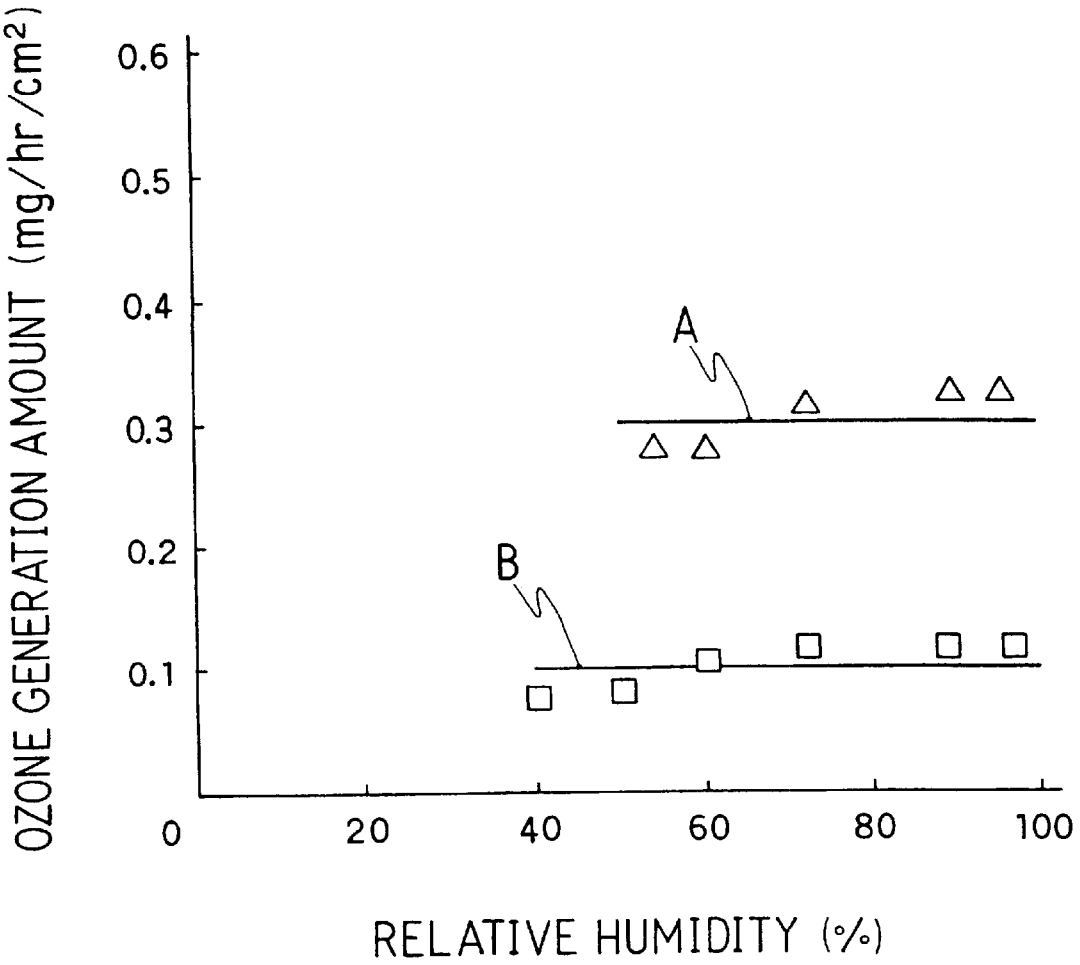
FIG. 3 is a view illustrating relationship between ozone generation amount and outside relative humidity in the jointed electrochemical device of the electrolysis gas converter according to Embodiment 1 of the present invention. In the figure, A and B indicate fixed current of 5 $mA/cm^2$ and 15 $mA/cm^2$, respectively.

Also, FIG. 3 shows the test results which demonstrate the effect of this embodiment. It is a view illustrating relationship between ozone generation amount per 1 $cm^2$ of the electrochemical reaction part of the jointed electrochemical device 8 and outside relative humidity in case of inducing 3 V of D.C. voltage by D.C. constant current power source 18 to the jointed electrochemical device with supplying each fixed current of, for example, 5 $mA/cm^2$ shown as A in the figure and 15 $mA/cm^2$ shown as B in the figure.

Figure 4:
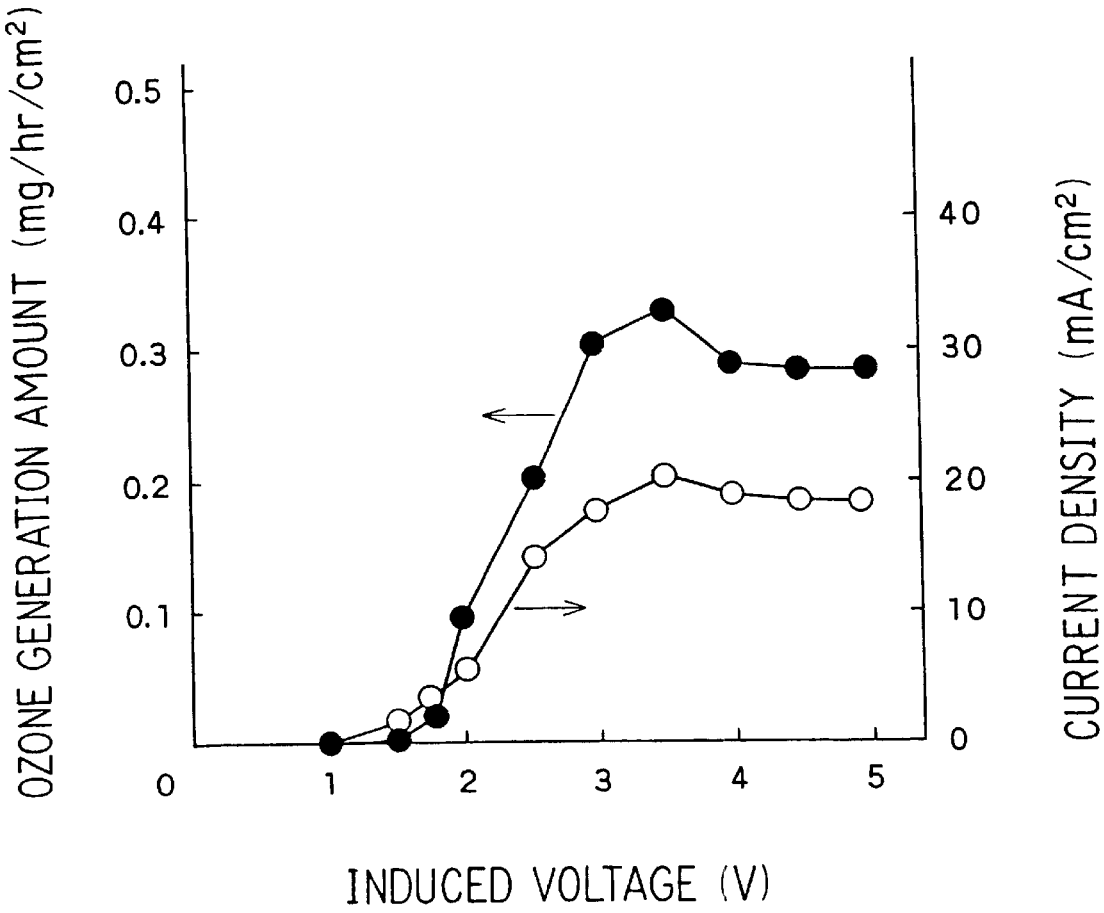
FIG. 4 is a view illustrating relationship between ozone generation amount from the jointed electrochemical device of the electrolysis gas converter according to Embodiment 1 of the present invention and induced voltage, and between current density and the induced voltage.

FIG. 4 is a view illustrating relationship of ozone generation amount and current density against induced voltage based on 1 $cm^2$ of the electrochemical reaction part of the jointed electrochemical device 8 at 20° C. under relative humidity of 60%.

Referring now to the operation, the ozone generation amount and the current density of the jointed electrochemical device 8 increase when outside humidity increases, while the ozone generation amount increases in accordance with increase of current which flows through the jointed electrochemical device 8 as shown in FIG. 2. Therefore, fixed current was designed to flow into the jointed electrochemical device 8 even in case of high humidity by using the D.C. constant power source 18 comprising the D.C. power source 6 together with the PNP transistor 11 and the resistor 17 as shown in FIG. 1.

In other words, current 15, which can be calculated by dividing output voltage of the D.C. power source 6 with the sum of resistance of the resistor 17 and that between the base 13 and the emitter 12, flows through the emitter 12 and the base 13 on the PNP transistor 11. And this emitter current becomes constant without being affected by properties of the jointed electrochemical device 8 placed on the collector 14 side of the PNP transistor 11.

As a result, fixed current 16, which is calculated by multiplying the current 15 flowing between the emitter 12 and the base 13 with amplification factor of the PNP transistor 11, flows through the collector 14. And therefore, the fixed current 16 also flows into the jointed electrochemical device 8.

In this way, once the current 15 flowing through the resistor 17 of the D.C. constant current power source 18 is kept constant, the fixed current can flow through the jointed electrochemical device 8. The current flowing through the jointed electrochemical device 8 can be adjusted by suitably selecting a transistor or deciding voltage of the D.C. power source 6 and resistance of the resistor 17.

Additionally, as the above D.C. power source 6 of the D.C. constant current power source 18, there may be used a circuit having a function of converting AC to DC voltage, a first battery such as plurality of dry cells, a rechargeable secondary battery or the like.

Next, an effect of this embodiment is explained. As shown in FIG. 3, 3 V of DC voltage was induced to the jointed electrochemical device 8 by the DC constant current power source 18 with adjusting current to each fixed value of, for example 5 $mA/cm^2$ as A in FIG. 3 and 15 $mA/cm^2$ shown as B in Figure. As a result, there was an effect that excessive gas generation could be prevented with maintaining a stable ozone generation amount even if the relative humidity varied from 40% to about 100%.

In this embodiment, the electrochemical reaction part of the jointed electrochemical device 8 which is interposed between the anode 1 and the cathode 2 had an area of 4 $cm^2$, but the test results revealed that the electrochemical reaction area was not limited to 4 $cm^2$. A similar effect was obtained even when the area was smaller or larger than 4 $cm^2$.

Also, current flowing through the jointed electrochemical device 8 was fixed to 5 $mA/cm^2$ and 15 $mA/cm^2$ in this embodiment. However, it is not limited thereto, and a similar effect was obtained even when the constant current density was between 5 $mA/cm^2$ and 15 $mA/cm^2$, less than 5 $mA/cm^2$ or more than 15 $mA/cm^2$.

This embodiment described a case where 3 V of DC voltage was induced to the jointed electrochemical device 8 by using the DC constant current power source 18. It was found, however, that the ozone generation amount and the current density of the jointed electrochemical device 8 varied in accordance with induced voltage and characteristically, the variation was remarkable within the induced voltage range of 1.5 V to 4.5 V.

Accordingly, the current flowing through the jointed electrochemical device 8 is preferably fixed within the induced voltage range of 1.5 V to 4.5 V where the ozone generation amount and the current density of the jointed electrochemical device 8 vary sharply. More preferably, it is fixed within the range of 1.5 V to 3.5 V where the ozone generation amount and the current density of the jointed electrochemical device 8 vary more sharply.

Also, in case of using a plurality of dry cells for the DC power source 6, and when the induced voltage is adjusted to be lower than 3 V at which ozone generation amount is high and the constant current density to about 5 $mA/cm^2$ and 10 $mA/cm^2$, the ozone generation amount becomes smaller than that in case of inducing 3 V, but there is an effect that the period of the cell replacement becomes longer.

This embodiment described an ozone generator, but principles and conditions for operation of the jointed electrochemical device 8 are the same as in the ozone generator, and this embodiment is also applicable for an oxygen gas generator, a dehumidifying device or a hydrogen gas generator. In other words, by constructing fixed current flow with inducing DC voltage to the jointed electrochemical device 8, there can be obtained an effect that a stable gas conversion amount can be maintained without excessive gas generation even if outside air conditions such as humidity change.

Additionally, when the jointed electrochemical device 8 is used for generating oxygen gas or dehumidification, i.e. the electrolysis gas converter corresponds to an oxygen gas generator or an dehumidification device, there is used, for example, a material obtained by plating platinum onto a porous expand metal substrate made of titanium for the anode 1 of the jointed electrochemical device 8, and oxygen is generated at the anode while water leaks from the backside of the cathode 2. When it is used for generating hydrogen gas, i.e. the electrolysis gas converter corresponds to an hydrogen gas generator, there is used, for example, a material obtained by plating platinum onto a porous expand metal substrate made of titanium for the anode 1 and the cathode 2, and hydrogen is generated at the cathode 2.

Embodiment 2

Figure 5:
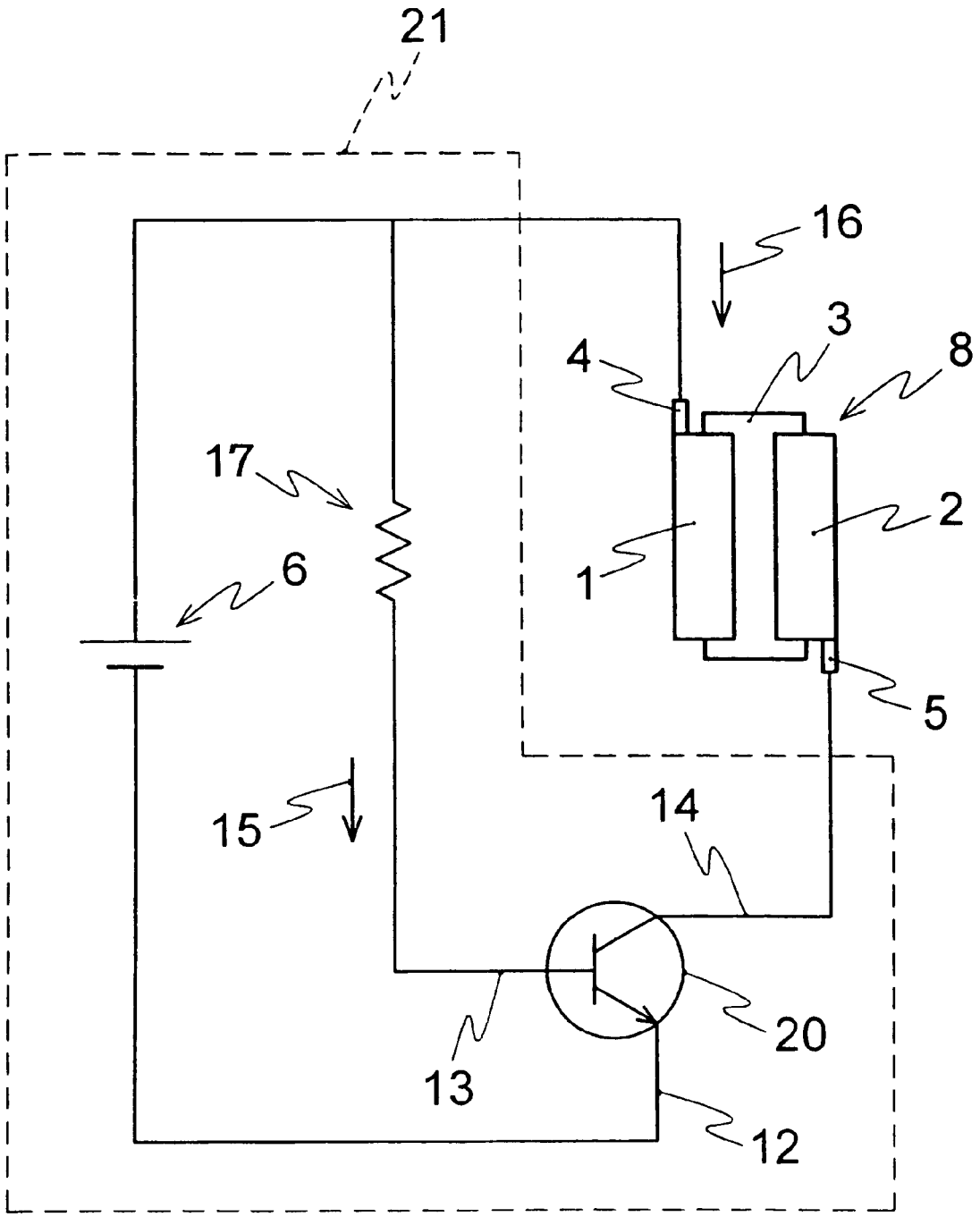
FIG. 5 is a view illustrating a construction of the electrolysis gas converter according to Embodiment 2 of the present invention.

A PNP transistor was employed in Embodiment 1 for generating fixed current flow, but an NPN transistor brings about the same effect as shown in FIG. 5.

FIG. 5 is a view illustrating the electrolysis gas converter according to Embodiment 2 of the present invention. In FIG. 5, numeral 20 indicates a NPN transistor and numeral 21 indicates a DC constant power source comprising a DC power source 6, an NPN transistor 20 and a resistor 17.

In this case, the jointed electrochemical device 8 is connected between a high electric potential output of the DC power source 6 and the collector 14 of the NPN transistor, and the emitter 12 is connected to a low electric potential output of the DC power source 6. Also, the resistor 17 is connected between the high electric potential output of the DC power source 6 and the base 13 of the NPN transistor.

Embodiment 3

Figure 6:
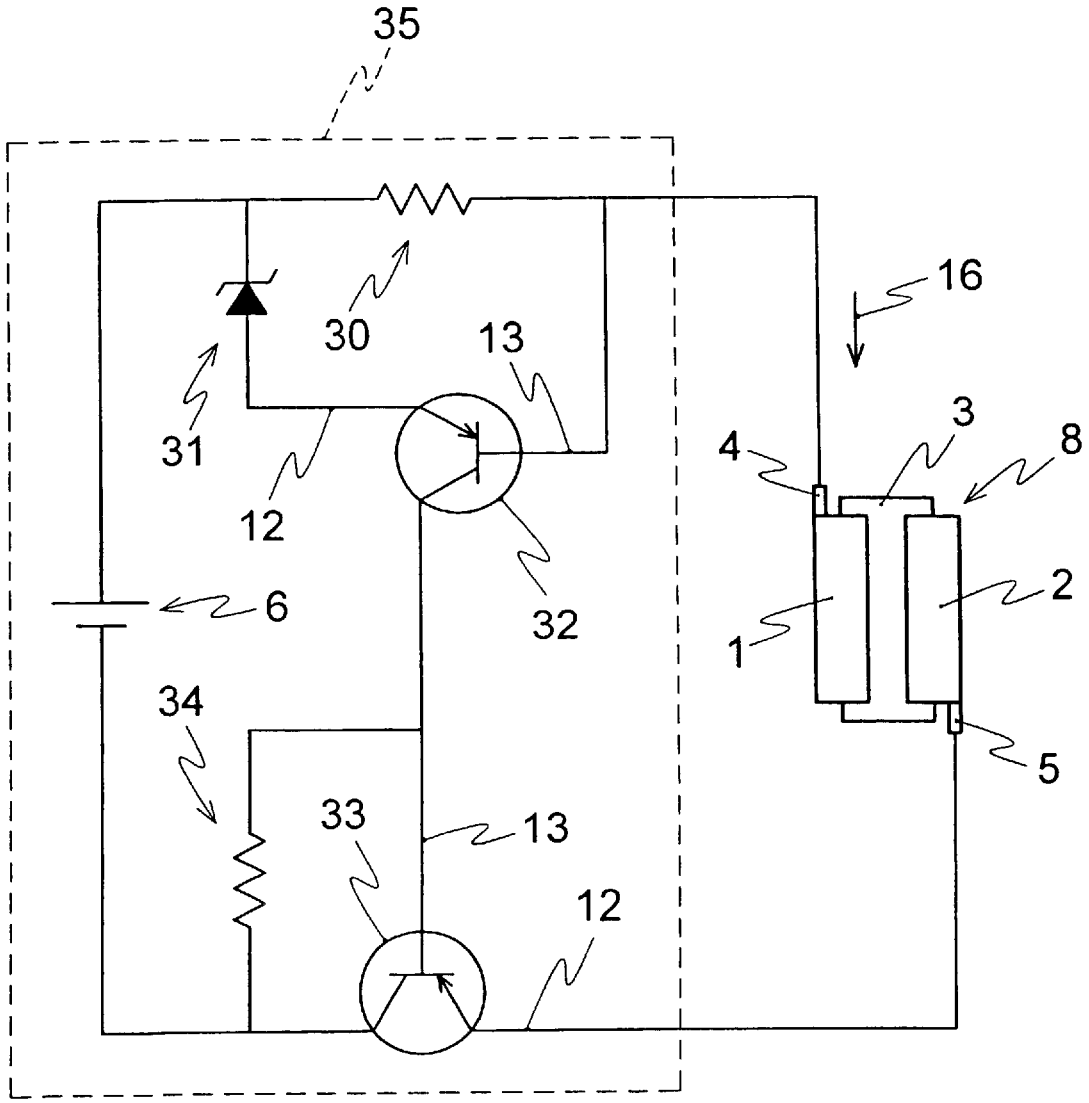
FIG. 6 is a view illustrating a construction of the electrolysis gas converter according to Embodiment 3 of the present invention.

FIG. 6 is a view illustrating the electrolysis gas converter according to Embodiment 3 of the present invention. This embodiment is designed to detect actual current flow and simultaneously control the fixed current flow through the jointed electrochemical device 8. In FIG. 6, numeral 30 indicates a resistor for detecting the current flowing through the jointed electrochemical device 8, numeral 31 Zener diode, numeral 32 and 33 a transistor such as PNP, numeral 34 a resistor and numeral 35 a DC constant power source which controls the current flowing through the jointed electrochemical device 8 to be fixed.

Next, reference is made to the operation of the thus constructed electrolysis gas converter according to Embodiment 3 of the present invention. Resistance of the jointed electrochemical device 8 is increased and current If of the current 16 is decreased with time increase. However, since resistance Rf at the resistor 30 is previously known, the value If of the current flowing through the jointed electrochemical device 8 can be easily detected by measuring voltage (Rf×If) at the both ends of the resistor 30. Therefore, measurement of the voltage indicates when to replace the jointed electrochemical device 8.

The voltage in proportion to the current value If is compared with the Zener voltage at the Zener diode 31, and current corresponding to the difference thereof flows through the base 13 of the transistor 32. As a result, when the current If becomes larger than required value, the current at this base 13 becomes small and in consequence, the current at the base 13 of the transistor 33 becomes small. In response to this, there can be an effort to lower the current at the emitter 12 of the transistor 33, namely the current at the jointed electrochemical device 8, which finally enables to maintain the desired fixed current at the jointed electrochemical device 8.

In this way, the current actually flowing through the jointed electrochemical device 8 can be detected in this embodiment and therefore, it is possible to know when to replace the jointed electrochemical device 8, and to control the fixed current flow more accurately in response to the change of the current actually flowing through the jointed electrochemical device 8.

Embodiment 4

The electrolysis gas converter according to Embodiment 4 of the present invention is explained below with an ozone generator as an example.

Figure 7:
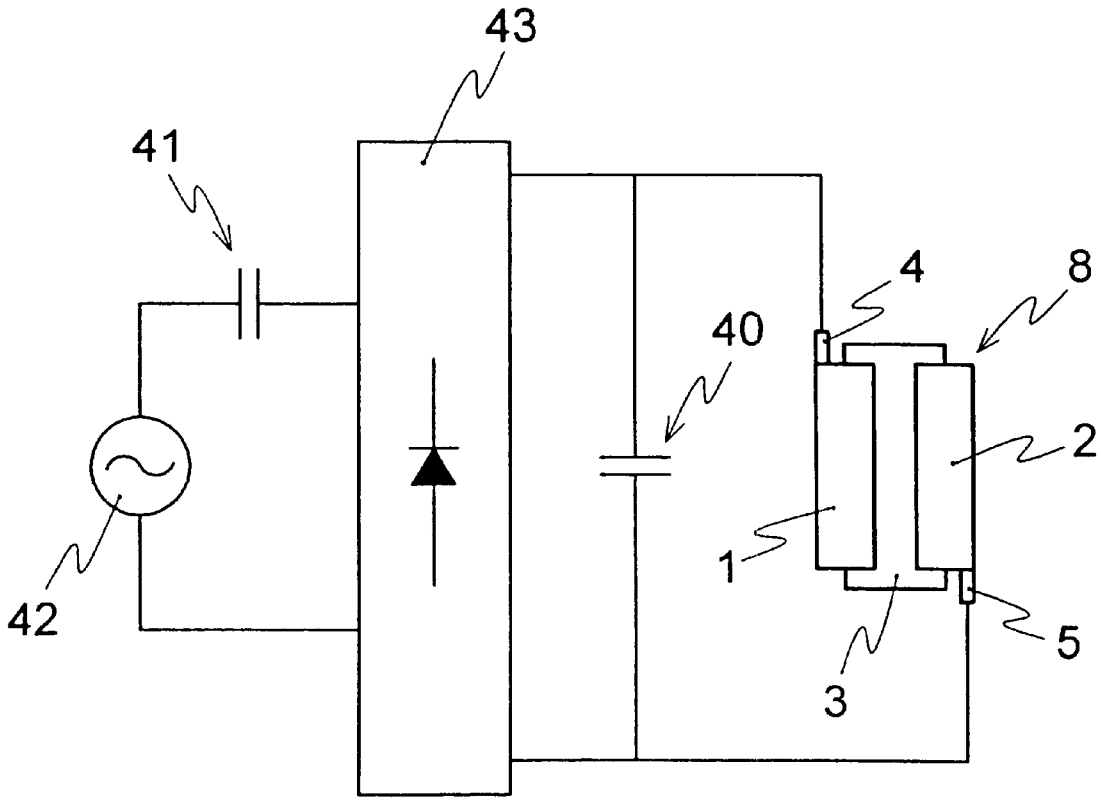
FIG. 7 is a view illustrating a construction of the electrolysis gas converter according to Embodiment 4 of the present invention.

FIG. 7 is a view illustrating the electrolysis gas converter according to Embodiment 4 of the present invention. In FIG. 7, numeral 40 indicates a voltage smoothing condenser, numeral 41 a charge-controlling condenser, numeral 42 an AC input such as a commercial power source and 43 a rectification circuit constituting a full wave rectification circuit or the like.

Figure 13:
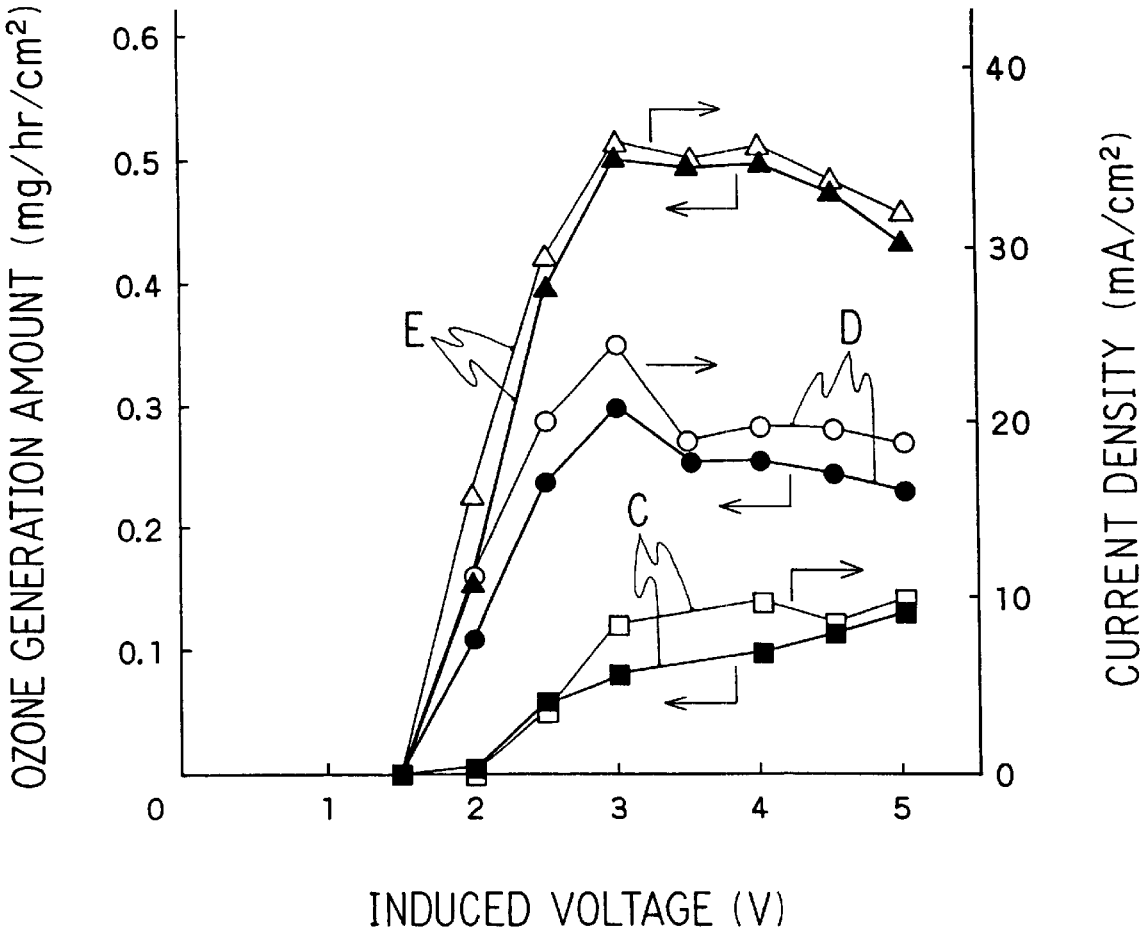
FIG. 13 PRIOR ART
FIG. 13 is a view illustrating influence of relative humidity to relationship between ozone generation amount and induced voltage, and between current density and the induced voltage in the jointed electrochemical device of the conventional electrolysis gas converter. In the figure, A, B and C indicate relative humidity of 35% 60% and 95%, respectively.

Next, explanation is made as to operation. Since the jointed electrochemical device 8 in the circuit of FIG. 7 operates with a few voltage as shown in FIG. 13, the output $V_0$ of the rectification circuit 43 is also adjusted to a few voltage, which is small enough compared to the output of 100 V of a commercial AC power source or the like.

In case of using the commercial power source of 100 V, about 100 V of effective voltage per 50 or 60 cycles (hereinafter represented by 60 cycles) is induced at the both ends of the charge-controlling condenser 41, and charge in proportion to the voltage variation is transmitted to the rectification circuit 43. In other words, charge inputted into the rectification circuit 43 per minute, i.e. an average current I in is obtained by $$I_{in} \cong 100 \times 1.414 \times 4 \times 60 \times Cq$$

wherein Cq indicates capacitance of the charge controlling condenser 41 and 4 is a coefficient of an integral value per a voltage cycle, and the current inputted into the rectification circuit 43 is roughly determined according to the capacitance Cq of the charge controlling condenser 41. Since the current $I_{out}$ outputted from the voltage-smoothing condenser 40 equals to $I_{in}$, the current flowing through the jointed electrochemical device 8 is determined according to the Cq.

For example, output current I out determined by Cq is adjusted so that the current density of the jointed electrochemical device 8 becomes 10 mA/cm$^2$. Judging from the characteristics of the jointed electrochemical device 8 in FIG. 13, the current density becomes 10 mA/cm$^2$ with the induced voltage of 4 V to 5 V at the relative humidity of 35% and the ozone generation amount is 0.10 to 0.13 mg/hr/cm$^2$. Similarly, the ozone generation amount is 0.09 mg/hr/cm$^2$ and 0.10 mg/hr/cm$^2$ at the relative humidity of 60% and 95%, respectively. Thus, it is found that the ozone generation amount is almost constant.

As mentioned above, since the current inputted into the jointed electrochemical device 8 is fixed by Cq, the ozone generation amount can be stable even if the relative humidity is remarkably varied.

Figure 8:
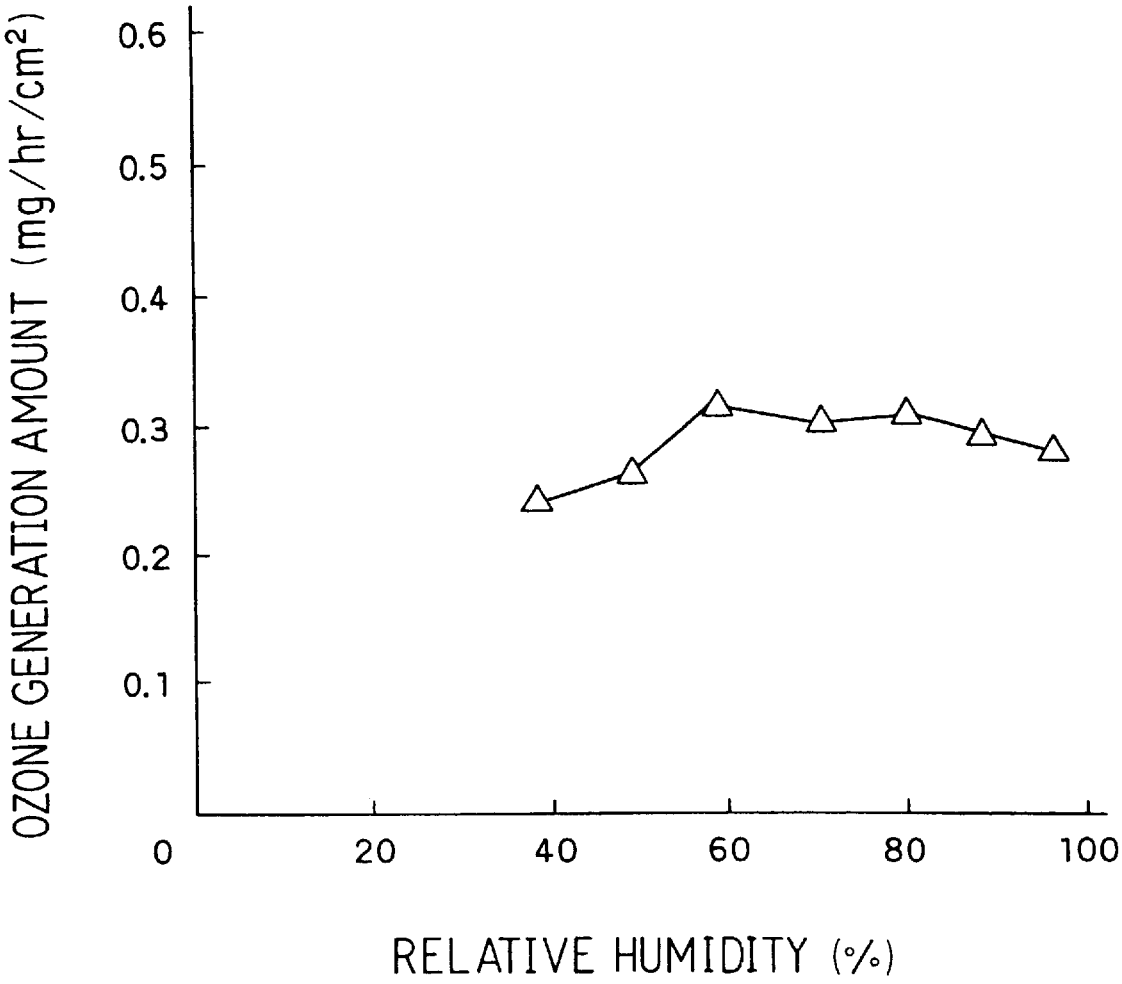
FIG. 8 is a view illustrating relationship between ozone generation amount and relative humidity in the jointed electrochemical device of the electrolysis gas converter according to Embodiment 4 of the present invention.

FIG. 8 shows the test results which demonstrate the effect of this embodiment. It is a view illustrating relationship between ozone generation amount per 1 cm$^2$ of the electrochemical reaction part of the jointed electrochemical device 8 and relative humidity. In the experiment, the current density inputted into the jointed electrochemical device 8 is adjusted to 20 mA/cm$^2$. The ozone generation amount in this case was 0.23, 0.30 and 0.28 mg/hr/cm$^2$ at the relative humidity of 40%, 60% and 95%, respectively to provide almost constant ozone generation amount.

Herein, explanation was made as to the case where the current density inputted into the jointed electrochemical device 8 was 20 mA/cm$^2$, but ozone generation amount was almost stable at each different current density in proportion to the current density regardless of relative humidity.

Though the capacitance Cq of the charge-controlling condenser 41 was fixed in this embodiment, Cq can be varied by switching a plurality of condensers with switching from one condenser to another. Since the jointed electrochemical device 8 shows characteristics that the ozone generation amount decreases when the time for running electricity becomes longer, the current flowing through the jointed electrochemical device 8 can be increased and the ozone generation can be kept constant if Cq is increased in accordance with the characteristics.

Since the output of the rectification circuit 43 includes ripple, the voltage-smoothing condenser 40 was employed in order to reduce the ripple in this embodiment. However, general LC smoothing circuit or RC smoothing circuit may be used. Also, since the DC current is supplied not to a general electric circuit but to the jointed electrochemical device 8 and ripple influence is small, there may be no smoothing circuit.

Embodiment 5

The electrolysis gas converter according to Embodiment 5 of the present invention is explained below with an ozone generator as an example.

Judging from the characteristics of the jointed electrochemical device 8 in FIG. 13, induced voltage is larger at the same current density in a low relative humidity condition than in high relative humidity condition. Referring now to the circuit in FIG. 7, since Cq value almost determines current, induced voltage may become about 10 V if the current density of the jointed electrochemical device 8 is adjusted to 20 mA/cm$^2$ under a relative humidity condition of 35%. When the induced voltage of the jointed electrochemical device 8 increases too much under a low relative humidity condition, there is possibility that the device 8 is broken due to voltage or excessive heat.

On the other hand, the ozone generation amount shows a tendency of saturation against to the induced voltage. For example, FIG. 13 shows that the ozone generation amount increases only slowly when the induced voltage of at least 3V is induced. Fixing of the current is not always suitable under such conditions.

Figure 9:
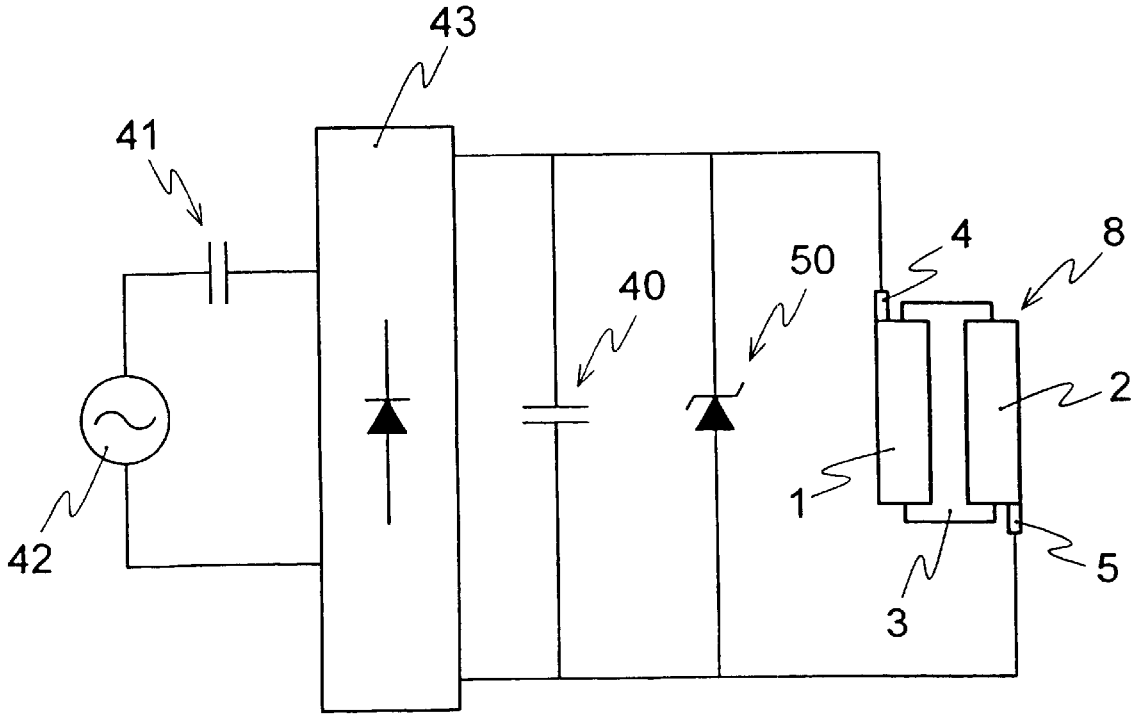
FIG. 9 is a view illustrating a construction of the electrolysis gas converter according to Embodiment 5 of the present invention.

FIG. 9 is a view illustrating the construction of an electrolysis gas converter according to Embodiment 5 of the present invention, wherein numeral 50 indicates Zener diode for voltage control. In the circuit of FIG. 9, the Zener diode is connected in parallel as a device and controls the voltage not to prevent excessive induced voltage.

Now, explanation is made as to operation. For example, the current density of the jointed electrochemical device 8 is adjusted to 20 mA/ cm$^2$ and the breakdown voltage of the Zener diode for voltage control 50 is adjusted to 5 V. The test results revealed that the ozone generation amounts were almost similar under relative humidity conditions of 95% and 60%, but it was slightly decreased since the induced voltage was controlled at 5V under relative humidity of 35%. Without the Zener diode for voltage control 50, there is possibility that further increase of the induced voltage may break the jointed electrochemical device 8 as mentioned above.

It is preferable that the breakdown voltage of the Zener diode for voltage control 50 in FIG. 9 is adjusted to a value larger than the voltage at which the ozone generation amount shows a tendency of saturation in relation to the induced voltage as in FIG. 13 which shows the characteristics of the jointed electrochemical device 8. It is, for example, preferably 3 V to 5 V.

Embodiment 6

The electrolysis gas converter according to Embodiment 6 of the present invention is explained with an ozone generator as an example. Though a Zener diode was used as the device to control the voltage induced to the jointed electrochemical device 8 in the circuit of FIG. 9, a similar effect can be seen when the device is an impedance device which can flow current at least proportionate to voltage with voltage increase. Therefore, the resistor and Zener diode may be in series.

Figure 10:
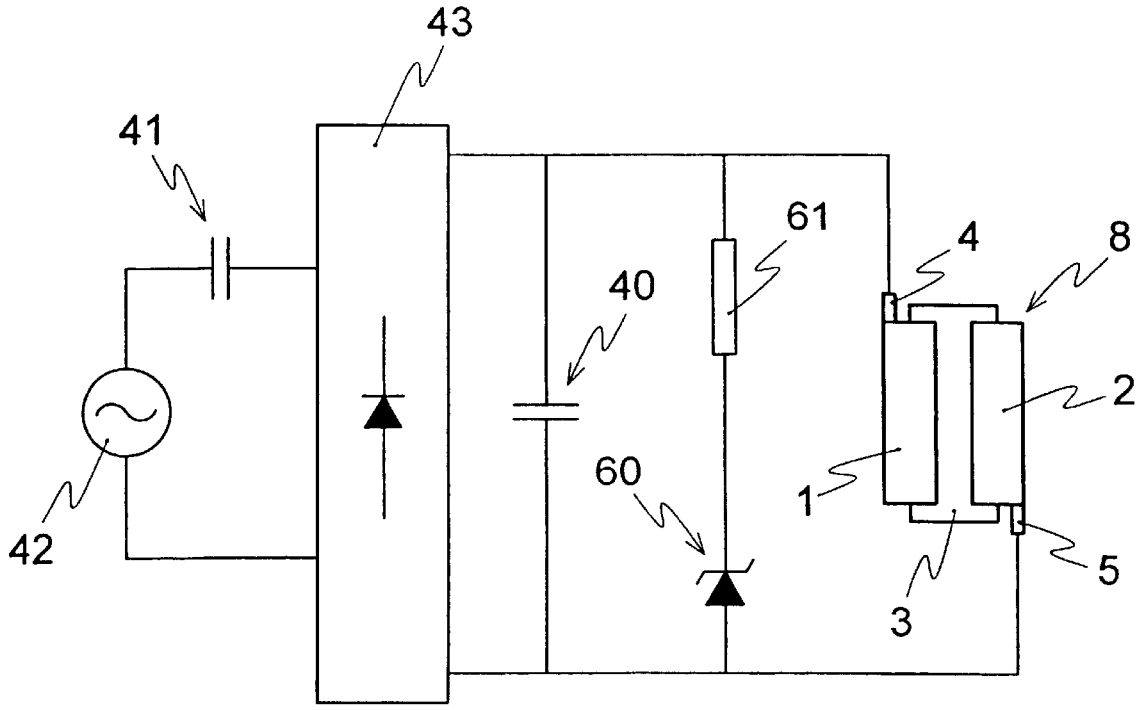
FIG. 10 is a view illustrating a construction of the electrolysis gas converter according to Embodiment 6 of the present invention.

FIG. 10 is a view illustrating a construction of the electrolysis gas converter according to Embodiment 6 of the present invention. In FIG. 10, numeral 60 indicates Zener diode connected in series and numeral 61 indicates a resistor for voltage control. When the induced voltage becomes at least the breakdown voltage of the series Zener diode 60, current which is determined by the voltage control resistor 61 starts to flow through series circuit.

Now, explanation is made as to operation. Judging from the characteristics of the jointed electrochemical device 8 in FIG. 13, the ozone generation amount shows a tendency of saturation against the induced voltage, but it also shows a tendency of slight increase under relative humidity of 35%. For example, when the breakdown voltage of the Zener diode for voltage control 50 is adjusted to 3 V in the circuit of FIG. 9, the ozone generation amount is only 0.08 mg/hr/cm$^2$.

On the contrary, when the series Zener diode 60 and the voltage control resistor 61 connected in series are used as the device for controlling the induced voltage as in the circuit of FIG. 10, and when the area of the electrochemical reaction part of the jointed electrochemical device 8 is 1 $cm^2$, under conditions that the breakdown voltage of the series Zener diode 60 is 3 V and the resistance at the voltage control resistor 61 is 140Ω, the current flowing through the jointed electrochemical device 8 is 10 mA while the current flowing through the voltage control resistor 61 is 7 mA according to the calculation: (4–3)/140≅7 mA, the total of which is 17 mA. Therefore, once the current determined by Cq is adjusted to 17 mA, the operating point is at 4 V. In consequence, 0.10 mg/hr/$cm^2$ of ozone generation amount can be obtained.

That is, in addition to the effect of controlling excessive induced voltage in Embodiment 5, larger amount of ozone can be generated even under a low relative humidity condition.

Additionally, it is possible to use a circuit comprising the jointed electrochemical device 8 and a resistor connected in parallel. In this case, decrease of the relative humidity decreases the current density and the ozone generation of the jointed electrochemical device 8. However, since a power source circuit for controlling a constant current flow is present in the present invention, the current flowing through the resistor connected in parallel is increased on the contrary, the current flowing through the jointed electrochemical device 8 is decreased. As a result, the voltage induced to the jointed electrochemical device 8 is increased to supplement the decrease of the ozone generation amount. However, this circuit cannot sufficiently supplement decrease of ozone amount caused by decrease of relative humidity.

Embodiment 7

Figure 11:
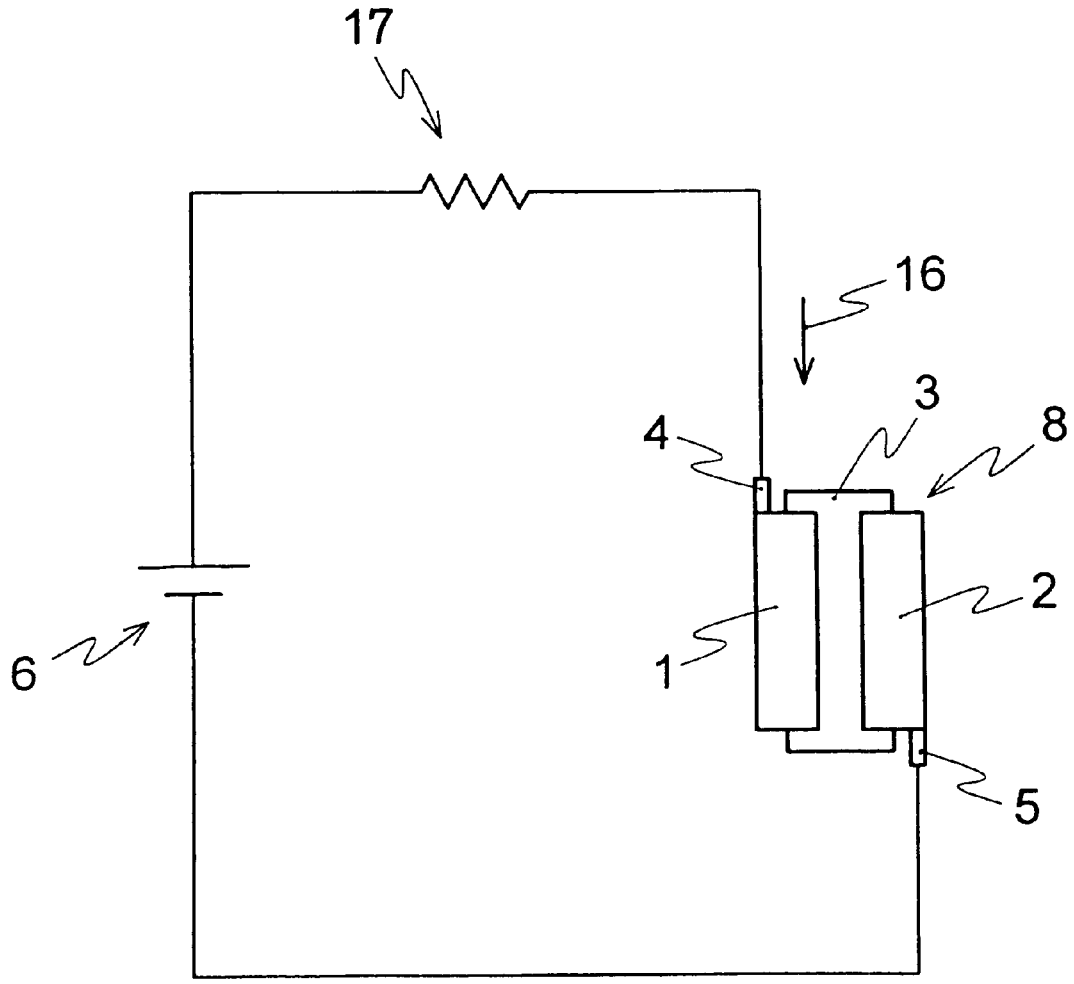
FIG. 11 is a view illustrating a construction of the electrolysis gas converter according to Embodiment 7 of the present invention.
Figure 12:
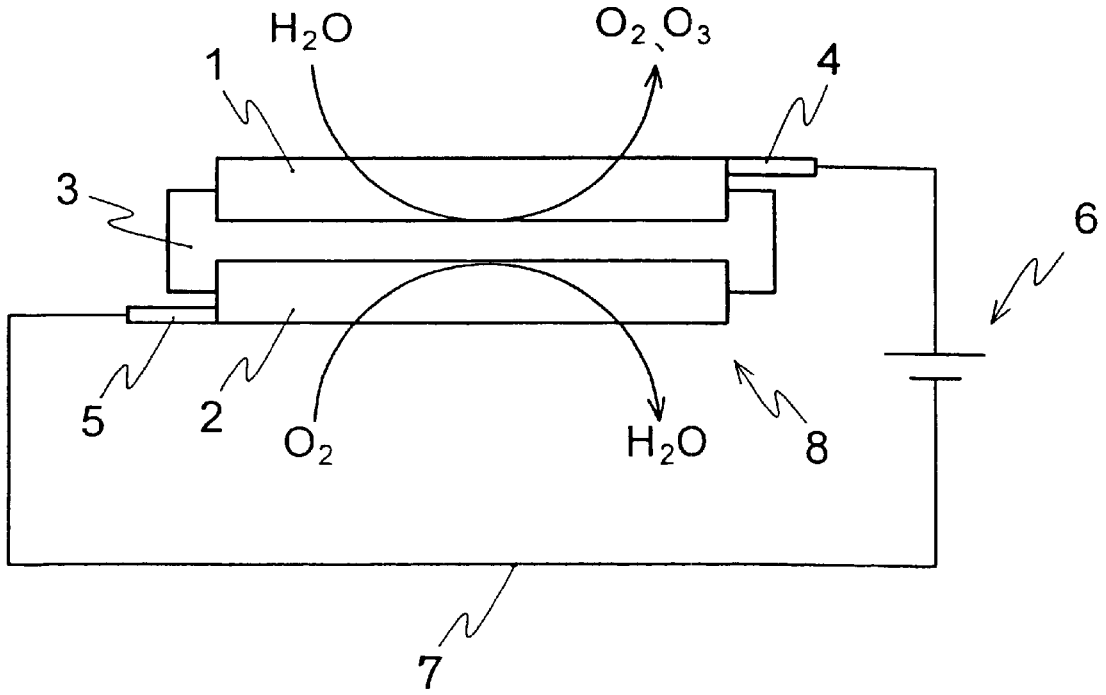
FIG. 12 PRIOR ART
FIG. 12 is a view illustrating a construction of a conventional electrolysis gas converter.

The electrolysis gas converter according to Embodiment 7 of the present invention is explained below with an ozone generator as an example. FIG. 11 is a view illustrating a construction of the electrolysis gas converter according to Embodiment 7 of the present invention.

Next, explanation is made as to operation. As shown in FIG. 13, the ozone generation amount and the current density of the jointed electrochemical device 8 are increased when outside relative humidity is increased, while the ozone generation amount is increased in accordance with increase of the current which flows through the jointed electrochemical device 8. On the other hand, load resistance of the jointed electrochemical device 8 during electricity flow varies complicatedly in accordance with the outside relative humidity. However, under a constant humidity condition and when the voltage induced to the electrochemical device 8 is at most 3 V, current flow is decreased to decrease ozone generation amount.

Then the resistor 17 was connected in series between the anode of the DC power source 6 and the anode 1 of the jointed electrochemical device 8 as shown in FIG. 11. By means of voltage drop caused by the current 16 flowing through the resistor 17, the voltage induced to the jointed electrochemical device 8 can be reduced under a high humidity condition to prevent excessive ozone generation.

According to the voltage drop caused by the current 16 (current If) flowing through the resistor 17 (resistance Rf), the voltage induced to the jointed electrochemical device 8 becomes smaller than the output voltage of the DC power source 6 by Rf×If value in the circuit of FIG. 11. As is known from FIG. 13, when humidity of outside air becomes high and the output voltage of the DC power source 6 is constant, the current If flowing between the jointed electrochemical device 8 and the resistor 16 is increased. Then the above voltage drop is increased as the outside relative humidity becomes high. The voltage induced to the jointed electrochemical device 8 is decreased as the voltage drop is increased. Consequently, the current flowing through the jointed electrochemical device 8 is decreased and the ozone generation amount is also decreased.

Therefore, by previously connecting the resistor 17 having a suitable resistance, the current outputted to the jointed electrochemical device 8 from the DC power source 6 can be fixed and excessive generation of ozone can be prevented even if humidity of outside air is high. Also, since the current flowing through the jointed electrochemical device 8 is decreased, a battery can be used longer when it is used as the DC power source 6.

Though the resistor 17 is connected between the anode of the DC power source 6 and the anode 1 of the jointed electrochemical device 8, it may be connected between the cathode of the DC power source 6 and the cathode 2 of the jointed electrochemical device 8.

Next, experiments were made to demonstrate the effect of this embodiment. The output voltage of the DC power source 6 was adjusted to 3 V and the resistance Rf of the resistor 17 to about 10Ω in case where the area of the electrochemical reaction part was 4 $cm^2$ in the jointed electrochemical device 8 based on the results in FIG. 13.

Under these settings, the voltage induced to the jointed electrochemical device 8 was 2.7 V at outside relative humidity at 20° C. of 40% and 1.9 V at about 100% thereof. In this way, when the relative humidity is increased, the current If flowing through the jointed electrochemical device 8 is increased but the voltage induced to the jointed electrochemical device 8 is decreased due to the increasing voltage drop caused by the current If flowing through the resistor 17. Accordingly, no excessive current flows through the jointed electrochemical device 8 and the ozone generation amount can be almost constant. From the test results, there was an effect that almost constant ozone generation was maintained even if the outside relative humidity changed 40% to about 100%.

Also, though the output voltage of the DC power source 6 was 3 V in this embodiment, it may be higher than 3 V according to the test results in FIG. 13. The resistance Rf of the resistor 17 may be adjusted so that the voltage induced to the jointed electrochemical device 8 is in the range of 1.9 V to 3.5 V depending on the change of the outside relative humidity. Alternatively, the output voltage of the DC power source 6 may be lower than 3 V and the ozone generation amount in this case is smaller than that at 3 V.

In this embodiment, the electrochemical reaction part of the jointed electrochemical device 8 which was interposed between the anode 1 and cathode 2 had an area of 4 $cm^2$, but the test results revealed that the electrochemical reaction area was not limited to 4 $cm^2$. A similar effect was obtained even when the area was smaller or larger than 4 $cm^2$. The value at resistor 17 was 10Ω when the reaction area was 4 $cm^2$. However, it may be larger than 10Ω when the reaction area is larger than 4 $cm^2$, while it may be smaller than 10Ω when the reaction area was smaller than 4 $cm^2$ based on the test results in FIG. 13.

This embodiment also described a case where the outside relative humidity changes from 40% to about 100%, but the range is not limited thereto. Temperature higher than 20° C. and further higher absolute humidity can bring about a similar effect.

Although the resistor 17 was a fixed resistance in this embodiment, variable resistance is more preferable in terms of the complicated change of the resistance in the jointed electrochemical device 8 attributable to the outside air humidity. Occasionally, the resistance is changeable depending on characteristic change of the jointed electrochemical device 8 against time.

Also, since the resistance Rf of (variable) resistor 17 is previously known, the current flowing through the jointed electrochemical device 8 can be easily detected by measuring voltage (Rf×If) at the both ends of the (variable) resistor 17. Therefore, upon measuring the voltage, the voltage induced to and the current flowing through the jointed electrochemical device 8 can be detected, and change in characteristics of the jointed electrochemical device 8 can be found to know indicates.

Embodiment 8

For example, when the jointed electrochemical device 8 is applied to electric appliances such as an air conditioner, a refrigerator, and a dish washer as an ozone generator, and if the jointed electrochemical device 8 is designed to receive a fixed current based on FIG. 13 in order to achieve a determined ozone concentration in these electric appliances by using the circuit of the present invention shown in FIGS. 1, 5, 6, 7, 9, 10 or 11, ozone concentration does not become excessively high inside the electric appliances, it is safe, and the ozone generation is almost constant even in a high humidity environment, and therefore, it is possible to obtain the determined ozone concentration.

Furthermore, a similar effect can be obtained when the circuit of the present invention is applied to an automobile, a vacuum cleaner, a food container, a garbage container and the like, as well as to the above electric appliances.

Also, in case of using the jointed electrochemical device 8 as a dehumidifying device, an oxygen gas generation or a hydrogen gas generation, the gas generation can be constant if the jointed electrochemical device 8 is designed to receive a fixed current by applying the circuit of the present invention shown in FIGS. 1, 5, 6, 7, 9, 10 or 11.

According to the first, second and fourth gas converters of the present invention, since it comprises a jointed electrochemical device, which is obtained by inserting a solid polymer electrolytic film between an anode and a cathode having a catalytic layer on a base substrate of conductive porous material, and to which DC is induced, and the above converter is equipped with a means for supplying a fixed current to the jointed electrochemical device, it is possible to obtain an electrolysis gas converter which prevents excessive gas generation and can maintain a constant amount of gas conversion without being influenced by the change of outside air conditions such as humidity.

According to the third gas converter of the present invention, since the device for controlling the voltage induced to the jointed electrochemical device is connected in parallel to the jointed electrochemical device, it is possible to prevent generation of excessive voltage and too much heat to the jointed electrochemical device caused thereby even when outside humidity becomes low.

According to the fifth, sixth and seventh gas converters of the present invention, since the above jointed electrochemical device is used as an ozone generator, a fixed current flows through the jointed electrochemical device safely without generating excess ozone amount and the ozone generation amount is almost constant even in a high humidity environment.

According to the eighth, ninth and tenth gas converters of the present invention, since the above jointed electrochemical device is used as an oxygen gas generator, a fixed current flows through the jointed electrochemical device and the generation amount of the oxygen gas can be constant regardless of environmental conditions.

According to the eleventh, twelfth and thirteenth gas converters of the present invention, since the above jointed electrochemical device is used as a hydrogen gas generator, a fixed current flows through the jointed electrochemical device and the generation amount of the hydrogen gas can be constant regardless of environmental conditions.

According to the fourteenth, fifteenth and sixteenth gas converters of the present invention, since the above jointed electrochemical device is used as a dehumidifying device, a fixed current flows through the jointed electrochemical device and dehumidification can be constant regardless of environmental conditions.

According to the first, second and third electric appliances of the present invention, since the appliances comprises the above jointed electrochemical device, the gas generation amount can be almost constant regardless of environmental conditions.

What is claimed is:

1. An electrolysis gas converter comprising:

a jointed electrochemical device including a solid polymer electrolytic film interposed between an anode and a cathode having a catalytic layer on a base substrate of conductive porous material, and which decomposes water in air by inducing DC current thereto; and a means for supplying a fixed current to the jointed electrochemical device, wherein the DC current is supplied through a rectification circuit from an alternating inputs and the means for supplying the fixed current flow comprises a condenser connected in series between the alternating input and the rectification circuit.

2. An electrolysis gas converter according to claim 1, wherein a device for controlling voltage induced to the jointed electrochemical device is connected in parallel to the jointed electrochemical device.

3. An electrolysis gas converter comprising:

a jointed electrochemical device including a solid polymer electrolytic film interposed between an anode and a cathode having a catalytic layer on a base substrate of conductive porous material, and which decomposes water in air by inducing DC current thereto; and a means for supplying a fixed current to the jointed electrochemical device, wherein the means for supplying the fixed current flow is connected in series between the jointed electrochemical device and a DC power source.

4. An electrolysis gas converter according to claim 2, wherein the jointed electrochemical device is used as an ozone generator.

5. An electrolysis gas converter according to claim 1, wherein the jointed electrochemical device is used as an ozone generator.

6. An electrolysis gas converter according to claim 3, wherein the jointed electrochemical device is used as an ozone generator.

7. An electrolysis gas converter according to claim 2, wherein the jointed electrochemical device is used as an oxygen gas generator.

8. An electrolysis gas converter according to claim 1, wherein the jointed electrochemical device is used as an oxygen gas generator.

9. An electrolysis gas converter according to claim 3, wherein the jointed electrochemical device is used as an oxygen gas generator.

10. An electrolysis gas converter according to claim 2, wherein the jointed electrochemical device is used as a hydrogen gas generator.

11. An electrolysis gas converter according to claim 1, wherein the jointed electrochemical device is used as a hydrogen gas generator.

12. An electrolysis gas converter according to claim 3, wherein the jointed electrochemical device is used as a hydrogen gas generator.

13. An electrolysis gas converter according to claim 2, wherein the jointed electrochemical device is used as a dehumidifying device.

14. An electrolysis gas converter according to claim 1, wherein the jointed electrochemical device is used as a dehumidifying device.

15. An electrolysis gas converter according to claim 3, wherein the jointed electrochemical device is used as a dehumidifying device.

16. An electric appliance comprising:

at least one of an air conditioning unit, a refrigeration unit, and a dish washing unit; and the electrolysis gas converter of claim 2.

17. An electric appliance comprising:

at least one of an air conditioning unit, a refrigeration unit, and a dish washing unit; and the electrolysis gas converter of claim 1.

18. An electric appliance comprising:

at least one of an air conditioning unit, a refrigeration unit, and a dish washing unit; and the electrolysis gas converter of claim 3.

* * * * *